United States Patent [19]

Jacquemet

[11] Patent Number: 4,799,557

[45] Date of Patent: Jan. 24, 1989

[54] ELECTROMAGNETIC PILE DRIVER

[75] Inventor: Georges Jacquemet, Caluire, France

[73] Assignee: Martelec - Societe Civile Particuliere, Caluire, France

[21] Appl. No.: 853,357

[22] Filed: Apr. 17, 1986

[30] Foreign Application Priority Data

Apr. 29, 1985 [FR] France ..... 85 06871

[51] Int. Cl.[4] ..... B25D 13/00

[52] U.S. Cl. ..... 173/91; 173/117

[58] Field of Search ..... 173/117, 139, 91, 90, 173/134, 139; 55/112, 300; 83/575; 405/232; 361/152, 156, 155, 205; 318/687, 135; 310/30

[56] References Cited

U.S. PATENT DOCUMENTS

| | | | |
|---|---|---|---|
| 2,967,302 | 1/1961 | Loveless | 173/117 |
| 3,504,480 | 4/1970 | Copcutt et al. | 55/112 |
| 4,215,297 | 7/1980 | Jacquemet | 310/30 |
| 4,305,736 | 12/1981 | Kahl et al. | 173/117 |
| 4,468,594 | 8/1984 | Jacquemet | 173/91 |
| 4,490,771 | 12/1984 | Huber et al. | 361/205 |
| 4,607,311 | 8/1986 | Brown et al. | 361/155 |

FOREIGN PATENT DOCUMENTS

| | | | |
|---|---|---|---|
| 2507676 | 9/1976 | Fed. Rep. of Germany . | |
| 153018 | 11/1981 | Japan | 173/139 |
| 1216342 | 3/1986 | U.S.S.R. | 173/90 |

*Primary Examiner*—Donald R. Schran
*Assistant Examiner*—James L. Wolfe
*Attorney, Agent, or Firm*—Herbert Dubno

[57] ABSTRACT

An electromagnetic pile driver has an elongated guide in which a magnetic core is permitted to fall by gravity to impact against an anvil transmitting the impact energy to the pile. The core is raised by a coil in a ferromagnetic sheath disposed at an upper portion of the guide and an upper anvil can be provided and coupled to the pile when the apparatus is used for withdrawing piling. The coil is energized by the control discharge of a capacitor.

22 Claims, 4 Drawing Sheets

ELECTROMAGNETIC PILE DRIVER

FIELD OF THE INVENTION

My present invention relates to an electromagnetic impact apparatus and, more particularly, to an electromagnetic pile driver adapted to drive an element, e.g. a tubular pile, sheet piling, posts or similar functioning elements into the ground in a vertical or inclined orientation.

BACKGROUND OF THE INVENTION

The use of machines for driving elements in the ground has widespread applications in the formation of foundations for structures of all types and the elements which can be driven into the ground may vary in shape depending upon the particular purpose.

Tube piles, for example, which can be filled with concrete once driven in the ground, represent a major kind of pilings in widespread use. Sheet piling, for coffer dams or merely to enclose a particular region or as a barrier, are also common, the sheets being driven into the ground in interlocked contiguous relationship. Solid-cross section or post-type piles may also be driven into the ground.

Pile drivers which have been provided heretofore for this purpose are usually in one of three categories:

Electric or hydraulic vibrators operating at high frequency and which vibrate the piles into the ground.

Pneumatic hammers or pile drivers operating at an intermediate frequency and in which a reciprocatable mass is driven in alternating directions by compressed air.

Falling mass pile drivers as diesel, pneumatic, steam or hydraulic actuation which function at low frequencies. Generally an expanding or fluid pressure serves to raise the mass and is vented to permit the mass to fall at least in part by the action of gravity upon the pile or an anvil acting thereon.

The electric or hydraulic vibrators generate sinusoidal unidirectional force by coupling a rotary eccentric mass to the element to be driven into the ground. These machines generally operate effectively in sandy soils but in clay or rocky terrains give relatively poor results. Pneumatic hammers utilize a piston which is driven upwardly and downwardly alternately by expansion of the compressed air have been found to give better results in clay soils but the properties of these machines are a compromise between those with the vibrating machines described above and the falling-mass machines. The range of intermediate frequencies of the shocks or impacts delivered to the element usually between 2 and 10 Hz, precludes the use of large masses for impact transfer. Consequently, the amount of energy which can be transferred at each impact to the element may not be sufficient for certain types of elements.

In the falling mass machines, a relatively heavy piston, constituting the energy-transfer mass, is lifted by a fluid such as air, steam, oil under pressure, or another gas, e.g. a gaseous mixture which is exploded to provide an expansion (diesel) and then drops in free fall on the element to be driven into the ground.

Because of the large mass which is used and the nature of the mechanism for lifting same, this machine cannot function at an intermediate or high frequency and generally the frequency of operation of a falling mass unit is of the order of 1 Hz. These machines are effective in all types of terrain except possibly for extremely porous or loose soil utilizing diesel drop hammer machines.

In the falling-mass drop hammers, better results may be obtained in the lifting performance with one of the three forms of energy used, i.e. diesel, pneumatic and hydraulic, than in others while in other systems, the free-fall performance or reaction force relationships may give better results. However, these earlier systems are not fully effective in all cases and thus it has been desirable to seek alternative systems for driving piles or the like into the ground.

OBJECTS OF THE INVENTION

It is, therefore, the principal object of the present invention to provide an improved apparatus for driving piles and the like wherein the drawbacks of earlier systems can be avoided.

Another object of the invention is to provide a falling-mass pile driver utilizing a unique energy source for this type of pile driver and which, because of the energy source used, allows more efficient operation of a pile driver for all types of soils.

SUMMARY OF THE INVENTION

I have now found that the drawbacks of earlier systems can be avoided by providing a mass adapted to fall freely in a guide which is lifted electromechanically and which is encased by the guide or is encased within the guide, this coil being energized by an electric circuit for briefly exciting the coil to thereby raise the weight and thereafter being de-energized to permit the weight in free fall to impact upon the pile. The mass is preferably formed by a magnet core.

According to the invention, therefore, an electromagnetic impact tool, e.g. for driving piles, can have a vertically elongated guide defining a vertical guide channel, an electromagnetic coil mounted on the guide and surrounding the channel, a mobile electromagnet core forming an impact mass capable of free fall in the channel and positioned with respect to the electromagnet to be raised against gravity electromagnetically by energization of the electromagnet, and an anvil mounted movably in a lower end of the guide and adapted to be impacted by the core upon free fall by gravity of the core on de-energization of the coil for receiving an impact from the core, the anvil being positionable in contact with an element to be driven by the tool.

The electric circuit connected to the coil can comprise a capacitor, a charging circuit connected across the capacitor for charging same, and a discharging circuit including two conductors connecting the coil with the capacitor and including means in at least one of the conductors for discharging the capacitor, after it can have been previously charged by the charging circuit, through the coil to raise the core.

The charging circuit can include a rectifier bridge across an input of which an alternating current source is connected and having an output applied to the capacitor, the rectifier bridge having a branch provided with a thyristor whose conduction time controls the duration of application of charging current to the capacitor, the means including a timing circuit connected to a control electrode of the thyristor for controlling the duration of conduction of the thyristor.

The latter means can include a thyristor connected in series between the capacitor and the coil in one of the conductors, and a timing circuit connected to a control electrode of the thyristor for triggering same into conduction.

The last-mentioned means can include a position sensor at a lower portion of the guide for detecting position of the core and triggering the thyristor into conduction.

Advantageously, these means can include a quenching network connected to the thyristor for rendering same nonconductive, and a further position sensor on the guide responsive to the core reaching an upper position for enabling the quenching network.

Also, the quenching network can include a further thyristor connected across the first-mentioned thyristor, a resistor connected in series with the further thyristor, and a condenser connected to the further thyristor, the further thyristor having a control electrode connected to the timing network.

The thyristor can be a self-extinguishing extinction thyristor.

If desired, the tool can be used for removal of an element ensconced in the ground, a supplemental anvil is provided at an upper portion of the guide for impact by the core, the tool further comprising a stirrup connecting the element to the further anvil whereby impact upwardly upon the anvil draws the element from the ground.

For use in bottoming of a shaft, wherein the guide can be oriented in an off-vertical position, the guide is provided with a braking coil along the path of the core, and a further independent electric circuit including a loop containing a condenser and a switch in series with the braking coil and the condenser.

The further circuit can include a position sensor for the position of the core located on the guide substantially immediately below the braking coil for controlling the switch.

Advantageously, the coil is fully enclosed in the guide and defines the channel in a region of the coil, the core is elongated and can have a length which is a multiple of the axial length of the coil, the guide can have an axial length greater than that of the core, and the anvil can have an axially extending portion adapted to be received in a tube forming the element and projecting axially out of the guide, and an annular shoulder received within the guide with freedom of axial movement therein between two stop formations on opposite axial sides of the shoulder. The anvil can have a boss projecting upwardly from the shoulder in the channel and engageable by the core.

As noted, in one embodiment of the invention, the electric excitation circuit can include a capacitor connected to a charging circuit and provided with means in at least one of its conductors for initiating the controlled discharge of the capacitor in the coil. During the period of free fall of the core, therefore, the capacitor can be charged from the charging source and the charge of this source can be instantaneously or suddenly discharged through the coil to produce a reaction force which, regardless of the terrain, will add to the shock delivered by the falling core to the element driven into the ground.

The use of an electronic control of the charge in accordance with the invention permits simple control of the principal operating parameters of the electromagnetic hammer, namely the energy and frequency of the shocks by varying the voltage at the terminals of the storage capacitor.

The electronic command circuit, also referred to herein as a timing circuit can provide for repetitive automatic operation utilizing the sensors which have been described above. In other words, an automatic lifting pulse can be generated by discharge of the capacitor through the coil practically at the instant after the core has struck the anvil which transfers the energy to the element to be driven into the ground.

The self-braking phenomenon of the movable core during its lifting at the instant at which it begins to pass the upper extremity of the coil can be eliminated by providing the electronic quenching of the capacitor-discharge thyristor under the control of a position sensor for the movable core located substantially at the level of the upper part of the coil. This quenching circuit interrupts the excitation of the coil at a certain instant in the lifting of the movable core.

The apparatus described can be equipped relatively simply with a supplemental anvil at an upper portion of the guide which is connected by a stirrup with the element which has been driven in the ground to enable the apparatus to be used effectively for withdrawing the pile from the ground.

It has also been found to be advantageous to provide another complementary device for the apparatus described to limit the degree to which the core is raised. For example, in the case in which the pile is to be driven in a direction or orientation which is inclined to the vertical. In this case, the braking of the core by gravity is less strong than that which applies when the guide is upright. For slowing the upward movement of the core in this case, the apparatus can comprise a braking coil along the path of the core which is also enclosed in the guide and is energized at an appropriate moment to slow down the rise of the core. This braking coil can be disposed below the lifting coil and can be incorporated in an independent electric circuit forming a loop between the braking coil, a capacitor and a switch, the latter closing to initiate a braking action. The braking energy, converted into charge on this latter capacitor, can be recouped during the descent of the movable core by permitting the braking capacitor to discharge through the braking coil to accelerate the core.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
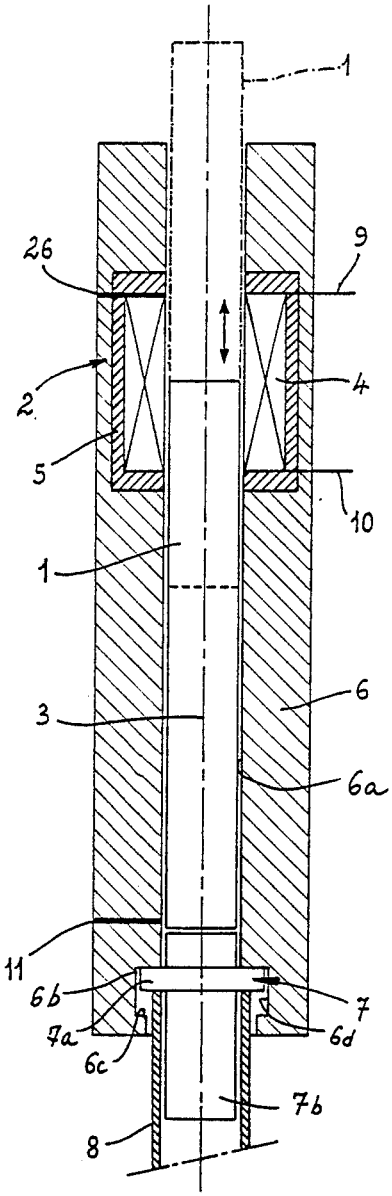
FIG. 1 is a vertical cross-sectional view diagrammatically illustrating an electromagnetic drop hammer or pile driver in accordance with the invention.

FIG. 1 of the drawing shows an electromagnetic drop hammer or pile driver in which a free falling mass or core 1 is guided in an elongated body 6 provided with a guide bore 6*a* in which the core 1 can move vertically between, for example, the position shown in broken lines and in solid lines.

The core is thus able to move slidably along the vertical axis 3 through an electromagnet 2 formed by a coil 4 encased in a ferromagnetic housing 5.

The electromagnet 2 is mounted in an upper portion of the elongated tubular guide 6, the lower portion of which receives an anvil 7 whose annular flange 7*a* can move between shoulders 6*b* and 6*c* and a recess 6*d* in which the flange 7*a* is received. The flange 7*a* is unitary with a boss 7*b* which fits within the tube pile 8 to be driven into the ground. When the coil 4 is energized by a circuit of the type shown in FIGS. 4, 5 and 6, via the conductors 9 and 10, the core is attracted upwardly and upon de-energization of the coil falls downwardly to impact upon the anvil 7 and transfer this impact to the pile 8.

Figure 4:
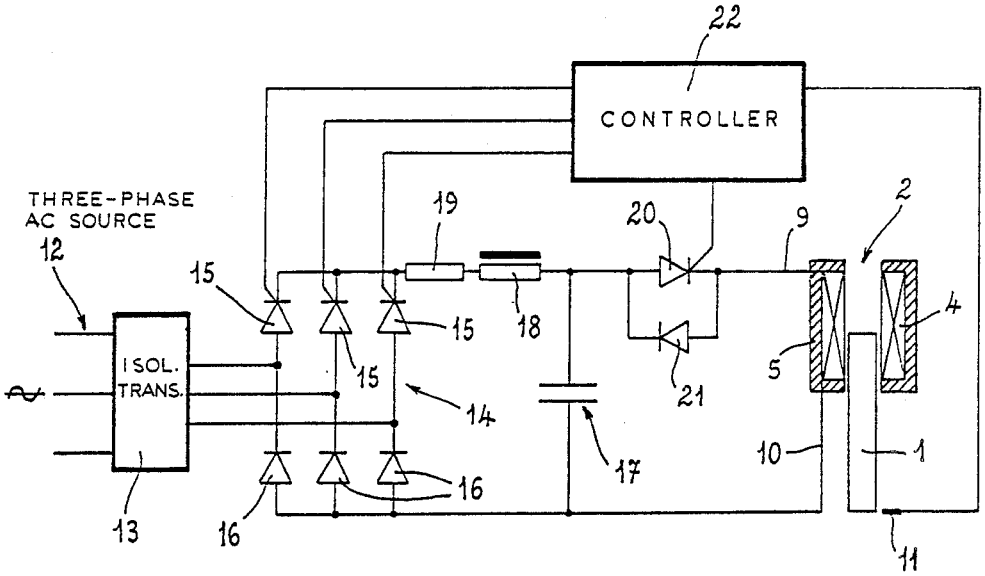
FIG. 4 is a circuit diagram of an electrical energization circuit for electromagnetic drop hammer or pile driver in accordance with the invention.

The electrical circuit for energizing the electromagnet coil 4 of the hammer is shown in FIG. 4 in which the core 1, the coil 4, the ferromagnetic shield 5 of the electromagnet 2 and the feed conductors 9 and 10, as well as the position sensor 11, which, as can be seen from FIG. 1, can be located at a point along the guide reached by the core 1 as it delivers its impact to the anvil 7.

The circuit of FIG. 4 comprises a three-phase alternating current source generally represented at 12 which feeds an isolating transformer 13 at the output of which a three-phase rectifier bridge 14 is provided.

This bridge comprises three thyristors 15 and three rectifier diodes 16.

Across the output of the bridge, a storage capacitor 17 is connected so that the thyristor bridges in series with a resistor 19 and a self-inductance or choke 18 constitute a charging circuit. The resistor 19 is a charging-current limiting resistor.

The feed conductors 9 and 10 of the coil 4 of the electromagnet 2 are connected respectively to the two terminals of the capacitor 17, a thyristor 20 being inserted into one of the conductors 9. A recovery diode 21 is bridged across the thyristor 20 and is connected in oppositely poled relationship to the latter. An electronic control module 22 forms a timing circuit connected to the control electrodes of the thyristors 15 and 20, i.e. to the gates thereof, as well as to the position sensor 11. The controller 22 regulates the charging and discharging cycle of the capacitor 17 which occurs in the following manner:

During the period of conduction of the thyristors 15, the capacitor 17 is charged through the choke inductor 18 and the resistor 19. By controlling the duration of the conduction of the thyristors 15, the controller or timing circuit 22 is able to vary the effective charge on the capacitor 17 prior to each discharge and thus the energy delivered on discharge by the capacitor to the coil. This of course varies the degree to which the core 1 is lifted during each discharge cycle of the capacitor 17.

When the thyristor 20 is rendered conductive, the energy stored in the capacitor 17 is discharged suddenly through the coil 4 of the electromagnet 2, attracting and lifting the mobile core 1. The variation of the energy stored in the capacitor 17 permits variation in the height to which the core 1 is lifted and thus control of the duration of the upward movement thereof.

Since the duration of the upward movement encloses the length of each lifting/dropping cycle of the core, I am thus able to control the cycle duration and hence the frequency of impact. The frequency of impact thus is inversely proportional to the energy stored per cycle in the capacitor.

The position sensor 11 automatically triggers the thyristor 20 through the controller 22 for automatic repetition of the cycle when the movable core 1 has impacted upon the anvil at the end of each preceding cycle.

Figure 5:
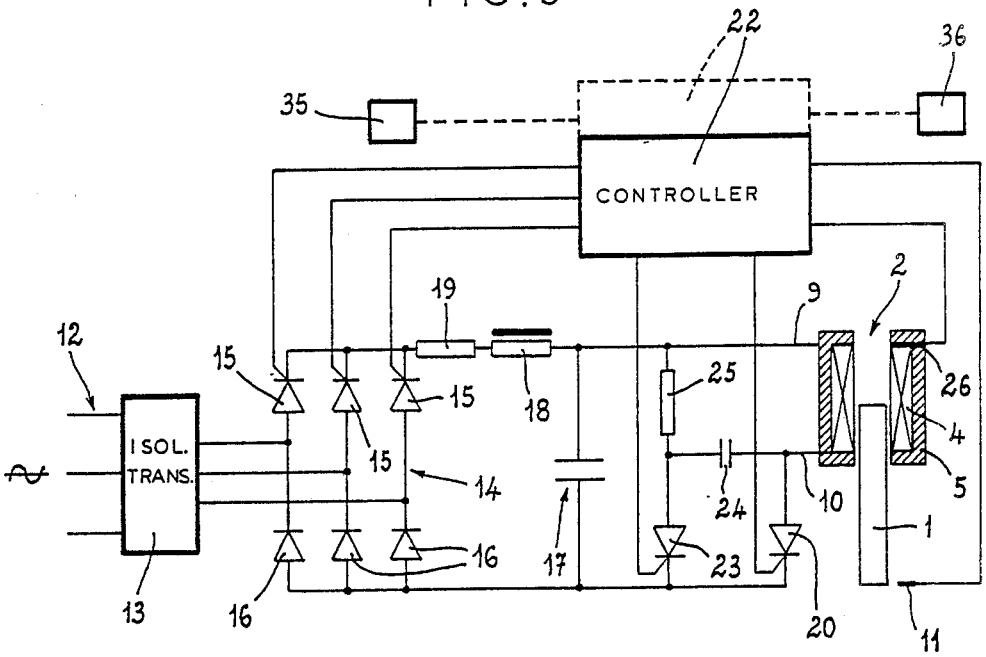
FIG. 5 is a circuit diagram illustrating an alternative circuit for this purpose.

FIG. 5 shows a variation in this feed circuit in which the thyristor 20 controlling the discharge of the capacitor is bridged by a network or circuit for quenching it. The quenching or extinction circuit comprises another thyristor 23, a condenser 24 and a resistor 25 connected as shown in the circuit diagram of FIG. 5.

The network 23, 24, 25 serves to quench the thyristor as follows:

The condenser 24 which is charged through the resistor 25 during conduction of the thyristor 20 is discharged through the thyristor 23 under the control of the circuit 22, thereby quenching thyristor 20.

The thyristor 23 is advantageously triggered by a position sensor 26 located at the upper extremity of the coil 4 (see also FIG. 1).

The sensor 26 is thus able to detect the instant at which the core reaches the top of the coil 2 and is about to exit the electromagnet to thereby create a self-braking phenomenon. Before this self-braking phenomenon can occur, therefore, the sensor 26 cuts off the energization of the coil 4. This is able to avoid the loss of energy which would result from a self-braking phenomenon.

Figure 2:
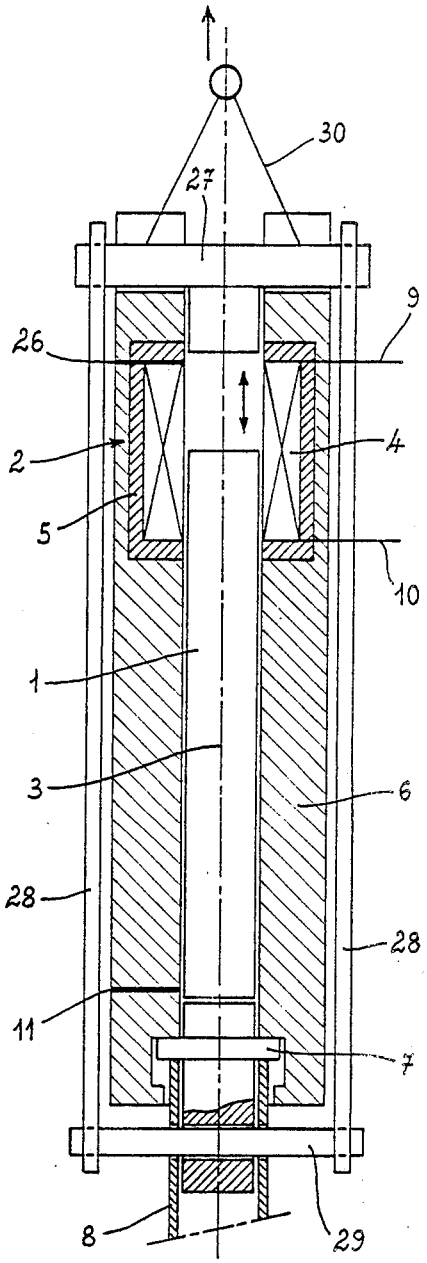
FIG. 2 is a view of another pile driver generally similar to that of FIG. 1, but equipped with means for pulling a pile out of the ground.
Figure 3:
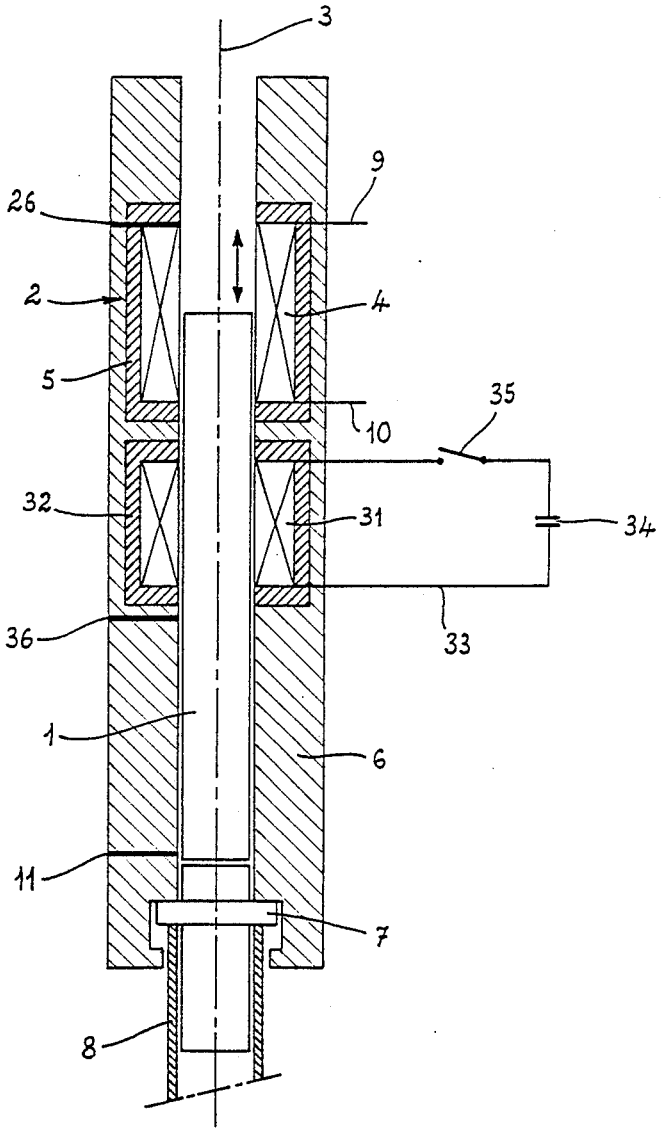
FIG. 3 is a similar sectional view of yet another pile driver equipped with a braking coil according to the invention so that it can be used effectively for inclined driving.
Figure 6:
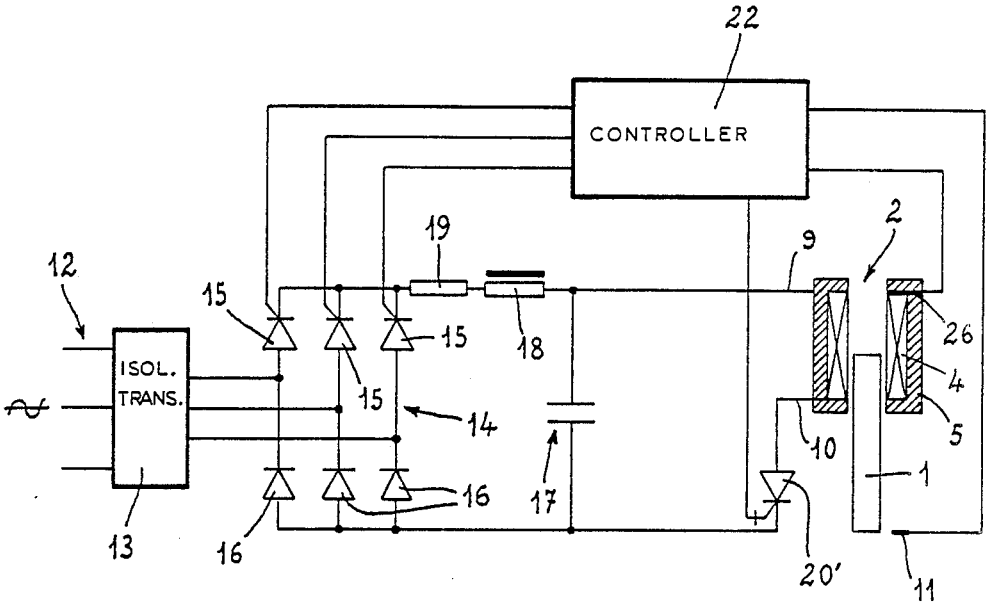
FIG. 6 is a circuit diagram showing a third embodiment of a feed circuit according to the invention.

Referring now to FIG. 6, in which I have shown still a third embodiment of the feed circuit for use with any of the electromagnetic hammers shown in FIGS. 1–3, it can be seen that here no special quenching means is required. The discharge thyristor 20′ is here a GTO or extinction thyristor connected in the discharge path of the capacitor 17. This type of thyristor is triggered into conduction by application to its gate of a signal of a given polarity and automatically is quenched by the passage to 0 of the current flow. In addition, it can be quenched by the application to its gate of an opposite polarity control signal by the electronic controller 22. Clearly by comparison with the circuit of FIG. 5, the circuit of FIG. 6 is simplified by elimination of additional quenching components by the use of an extension thyristor.

FIG. 2 shows an electromagnetic hammer or pile driver which corresponds essentially to that of FIG. 1 and in which corresponding elements to those of FIG. 1 have been identified with the same reference numerals. For example, the movable core 1 can be seen to be guided in the body 6 and cooperates with a coil 4 having a ferromagnetic shield 5 to form the electromagnet 2. The lower anvil 7 is likewise provided in this embodiment but, in addition, a mechanism is provided to allow withdrawal of a pile 8 which has previously been embedded in the ground.

This extraction mechanism includes a second anvil 27 provided at the top of the body 6 and comprising a boss which extends into the bore of this guide for impact by the rising core 1.

Laterally of the guide 6 are provided two stirrups 26 extending vertically and flanking the body 6 with their lower portions rigid with a pin 29 traversing the lower anvil 7 and the element 8. The pin 29 can be laterally insertable through the stirrup, the anvil 7 and the pile 8.

In operation, a hoist, such as a crane cable, not shown in the drawing, applies upward traction to the apparatus via an elastic cable suspension or a cable suspension provided with elastic shock dampers represented generally at 30.

When the coil 4 is energized, the core 1 is driven upwardly and violently impacts upon the upper anvil 27. The upwardly-directed shocks are transmitted to the pile 8 by the stirrups 28 and the pin 29. When the coil 4 is de-energized, the core 1 falls by gravity onto the anvil 7 to apply a downward impulse of lesser significance because of the upward traction on the apparatus. The cycle is repeated under the control of the sensor 11 and the circuits used can be either of those of FIGS. 4 or 5, provided of course, that a braking coil is not employed to impede the upward transmission of energy to the anvil 27.

FIG. 3 shows an electromagnetic hammer designed particularly to be used for driving inclined pilings or for an inclined impact, i.e. an off-vertical impact.

This electromagnetic driver utilizes the same elements as those of FIGS. 1 and 2 by and large, and the same reference numerals have therefore been utilized to designate them.

Here, however, a second coil 31 with its ferromagnetic shield 32 is disposed below the principal electromagnet 2. The supplemental coil 31 is connected in an independent electric circuit or loop 33 comprising a condenser 34 and a switch 35 in series with the coil 31 but not connected to any other source of electric current.

In use of the driver in an off-vertical position, the braking of the upward movement of the core 1 by gravity is less strong than when the assembly is perfectly upright. In this case, the circuit 33 can be switched into operation to limit the upward movement of the core.

As the lower extremity of the movable core 1 penetrates the coil 31, the switch 35 is closed, e.g. by the controller 22. The core 1, which is highly magnetized generates in the circuit 33 an electric current which charges the condenser 34 and simultaneously gives rise to a braking of the upward movement of the mass formed by the core. The condenser 34 discharges through the coil 31 contributing its braking energy to acceleration of the movement of the core 1 downwardly. The switch 35 is opened when the core reaches its lower position.

The circuits used can correspond to those of FIGS. 4 and 5 and the switch 35 can be formed by a thryristor or triac and it is advantageous to control this switch by a further position sensor 36 disposed on the guide 6 substantially at the level of the bottom of the supplemental coil 31. The control of the switch 35 can be effected by the electronic timer 22 and this relationship has been schematically illustrated in broken lines in FIG. 5.

It should be understood that the invention is not limited to the embodiments actually illustrated and described, but include all modifications within the spirit and scope of the appended claims. Without limitation, this can include the use of equivalent circuit elements for those shown in the various circuits, for example, replacement of diodes 16 by thyristors in the rectifier bridge 14, or by the replacement of the pin 29 shown in FIG. 2 by a tongs or other gripping arrangement depending upon the nature of the pile 8.

I claim:

1. An electromagnetic impact pile driver adapted to drive an elongated element into the ground in a substantially vertical orientation, said electromagnetic pile driver comprising:

an upright vertically elongated body having a vertical channel;

an electromagnetic coil fixedly mounted on said body and surrounding said channel;

means for periodically storing a predetermined amount of electrical energy;

means for periodically applying said amount of electrical energy to said coil so that, for each application, said coil is traversed by a high energy current pulse and passes successively, under the effect of said current pulse, to an energized state and thereafter to a de-energized state;

a mobile electromagnet core having an upper end and forming an impact mass guided in said channel, said core being positioned with respect to said coil so as to be electromagnetically attracted and lifted in a direction opposite to the elongated element at a predetermined levels, against gravity, in said energized state, and thereafter to free fall by gravity in said de-energized state, said upper end being located above said coil at said predetermined level;

means for controlling the amount of electrical energy stored and applied to said coil to vary said predetermined level to which said core is lifted with each of said energized states; and a pile-driving anvil axially mobile with respect to the elongated body and adapted to be positionable on said elongated element, to receive an impact from said core in said de-energized state of the coil and to transfer this impact to said elongated element with sufficient energy to drive said element into the ground and to produce a significant displacement of this element.

2. The impact pile driver according to claim 1 wherein said means for periodically storing a predetermined amount of electrical energy comprises at least a capacitor, said means for applying said amount of electrical energy on said coil comprises a discharging circuit which connects said capacitor to said coil and which comprises at least first controllable switching means adapted to cause the capacitor to be discharged in said coil after each impact while the impact mass is located at a lower portion of said elongated body, adjacent to said anvil.

3. The impact pile driver according to claim 2 wherein said capacitor is connected to a charging circuit through second controllable switching means.

4. The impact pile driver according to claim 3 wherein said charging circuit includes a rectifier bridge having an input on which an alternating current source is connected and an output connected to said capacitor, said rectifier bridge having at least a branch provided with a controllable valve having a control electrode connected to a control unit including a timing circuit so as to control the duration of the conduction of said valve and therefor the duration of application of charging current to said capacitor and to calibrate the said amount of electrical energy.

5. The impact pile driver according to claim 2 wherein said first switching means includes at least a thyristor connected in series between said capacitor and said coil, and a timing circuit connected to a control electrode of said thyristor for triggering same into conduction.

6. The impact pile driver according to claim 5 wherein said thyristor is a self-extinguishing extinction thyristor.

7. The impact pile driver according to claim 2 wherein said first controllable switching means is controlled by an electronic control circuit including a first position sensor located at the said lower portion for detecting the position of said core and triggering said first controllable switching means into conduction.

8. The impact pile driver according to claim 1 which further comprises a supplemental anvil provided at an upper portion of said elongated body for impact by said core, and a stirrup connecting said elongated element to said supplemental anvil, said stirrup being adapted so as to draw said elongated element from the ground when said core impacts on said supplemental anvil.

9. An electromagnetic impact pile driver adapted to drive an elongated element into the ground in a substantially vertical orientation, said electromagnetic pile driver comprising:

an upright vertically elongated body having a vertical channel;

an electromagnetic coil fixedly mounted on said body and surrounding said channel;

means for periodically storing a predetermined amount of electrical energy;

means for periodically applying said amount of electrical energy to said coil so that, for each application, said coil is traversed by a high energy current pulse and passes successively, under the effect of said current pulse, to an energized state and thereafter to a de-energized state;

a mobile electromagnet core forming an impact mass guided in said channel and which is positioned with respect to said coil so as to be electromagnetically attracted and lifted at a predetermined level, against gravity, in said energized state, and thereafter to free fall by gravity in said de-energized state; and a mobile pile-driving anvil adapted to be positionable on said elongated element, to receive an impact from said core in said de-energized state of the coil and to transfer this impact to said elongated element with sufficient energy to drive said element into the ground, said means for periodically storing a predetermined amount of electrical energy comprising at least a capacitor, said means for applying said amount of electrical energy on said coil comprising a discharging circuit which connects said capacitor to said coil and which comprises at least first controllable switching means adapted to cause the capacitor to be discharged in said coil after each impact while the impact mass is located at a lower portion of said elongated body, adjacent to said anvil wherein a quenching network is connected to said first controllable switching means for rendering same nonconductive, and a second position sensor on said elongated body responsive to said core reaching an upper position for enabling said quenching network is provided on said elongated body.

10. An electromagnetic impact pile driver adapted to drive an elongated element into the ground in a substantially vertical orientation, said electromagnetic pile driver comprising:

an upright vertically elongated body having a vertical channel;

an electromagnetic coil fixedly mounted on said body and surrounding said channel;

means for periodically storing a predetermined amount of electrical energy;

means for periodically applying said amount of electrical energy to said coil so that, for each application, said coil is traversed by a high energy current pulse and passes successively, under the effect of said current pulse, to an energized state and thereafter to a de-energized state, a mobile electromagnet core forming an impact mass guided in said channel and which is positioned with respect to said coil so as to be electromagnetically attracted and lifted at a predetermined level, against gravity, in said energized state, and thereafter to free fall by gravity in said de-energized state; and a mobile pile-driving anvil adapted to be positionable on said elongated element, to receive an impact from said core in said de-energized state of the coil and to transfer this impact to said elongated element with sufficient energy to drive said element into the ground, said means for periodically storing a predetermined amount of electrical energy comprising at least a capacitor, said means for applying said amount of electrical energy on said coil comprising a discharging circuit which connects said capacitor to said coil and which comprises at least first controllable switching means adapted to cause the capacitor to be discharged in said coil after each impact while the impact mass is located at a lower portion of said elongated body, adjacent to said anvil, wherein said first controllable switching means is controlled by an electronic control circuit including a first position sensor located at the lower portion of the elongated body for triggering said first controllable switching means into conduction upon detection of the core by said first sensor, and by a quenching network connected to said first switching means for rendering same nonconductive, said quenching network comprising a second position sensor provided on an upper part of said coil and responsive to said core reaching an upper position for enabling said quenching network.

11. An electromagnetic impact pile driver adapted to drive an elongated element into the ground in a substantially vertical orientation, said electromagnetic pile driver comprising:

an upright vertically elongated body having a vertical channel;

an electromagnetic coil fixedly mounted on said body and surrounding said channel;

means for periodically storing a predetermined amount of electrical energy;

means for periodically applying said amount of electrical energy to said coil so that, for each application, said coil is traversed by a high energy current pulse and passes successively, under the effect of said current pulse, to an energized state and thereafter to a de-energized state;

a mobile electromagnet core forming an impact mass guided in said channel and which is positioned with respect to said coil so as to be electromagnetically attracted and lifted at a predetermined level, against gravity, in said energized state, and thereafter to free fall by gravity in said de-energized state; and a mobile pile-driving anvil adapted to be positionable on said elongated element, to receive an impact from said core in said de-energized state of the coil and to transfer this impact to said elongated element with sufficient energy to drive said element into the ground, said elongated body being orientable in an off-vertical position, said elongated body is being provided with a braking coil and a further independent electric circuit including a loop containing a condenser and a switch in series with said braking coil and said condenser.

12. The impact pile driver according to claim 11 wherein said further electric circuit includes a third position sensor for the position of said core located on said elongated body substantially immediately below said braking coil for controlling said switch.

13. An electromagnetic impact pile driver adapted to drive an elongated element into the ground in a substantially vertical orientation, said electromagnetic pile driver comprising:

an upright vertically elongated body having a vertical channel;

an electromagnetic coil fixedly mounted on said body and surrounding said channel;

means for periodically storing a predetermined amount of electrical energy;

electrical energy storage means for applying repetitively on said coil a high energy current pulse of an adjustable level so as to cause for said pulse said coil to pass successively from an energized state to a de-energized state;

a mobile electromagnet core forming an impact mass guided in said channel and which is positioned with respect to said coil so as to be raised against gravity electromagnetically by said coil in said energized state and thereafter to free fall by gravity in said de-energized state; and a mobile anvil adapted to be positionable in contact with said elongated element and comprising:

means for receiving an impact from the core in the de-energized state of the coil and to transmit this impact to the elongated element to be driven into the ground; and rigid means disposed on said elongated element for supporting the elongated body at least during said energized state so as to receive a reaction force exerted on said body by said coil during the energized state, to transmit this force to the elongated element and to drive this element into the ground before each impact.

14. The impact pile driver as claimed in claim 13 wherein said coil is fully enclosed in said elongated body and defines said channel in a region of said coil, said core is elongated and has a length which is a multiple of the axial length of said coil, said elongated body has an axial length greater than that of said core, and said anvil has an axially extending portion adapted to be received in a tube forming said element and projecting axially out of said guide, and an annular shoulder received within said elongated body with freedom of axial movement therein between two stop formations on opposite axial sides of said shoulder.

15. The impact pile driver as claimed in claim 14 wherein said anvil has a boss projecting upwardly from said shoulder in said channel and engageable by said core.

16. The impact pile driver according to claim 33 wherein said electrical energy storage means comprises a capacitor, and a discharging circuit which connects said capacitor to said coil and which comprises at least first controllable switching means adapted to cause the capacitor to be discharged in said coil so as to produce therethrough said current pulse.

17. The impact pile driver according to claim 16 wherein said capacitor is connected to a charging circuit through second controllable switching means.

18. The impact pile driver according to claim 17 wherein said charging circuit includes a rectifier bridge having an input on which an alternating current source is connected and an output connected to said capacitor, said rectifier bridge having at least a branch provided with a controllable valve having a control electrode connected to a control unit including a timing circuit so as to control the duration of the conduction of said valve and therefor the duration of application of charging current to said capacitor.

19. The impact pile driver according to claim 16 wherein said first switching means includes at least a thyristor connected in series between said capacitor and said coil, and a timing circuit connected to a control electrode of said thyristor for triggering same into conduction.

20. The impact pile driver according to claim 16 wherein said first controllable switching means is controlled by an electronic control circuit including a first position sensor located at a lower portion of said elongated body for detecting the position of said core and triggering said first controllable switching means into conduction.

21. An electromagnetic impact pile driver adapted to drive an elongated element into the ground in a substantially vertical orientation, said electromagnetic pile driver comprising:

an upright vertically elongated body having a vertical channel;

an electromagnetic coil fixedly mounted on said body and surrounding said channel;

electrical energy storage means for applying repetitively on said coil a high energy current pulse of an adjustable level so as to cause for said pulse said coil to pass successively from an energized state to a de-energized state;

a mobile electromagnet core forming an impact mass guided in said channel and which is positioned with respect to said coil so as to be raised against gravity electromagnetically by said coil in said energized state and thereafter to free fall by gravity in said de-energized state; and a mobile anvil adapted to be positionable in contact with said elongated element and comprising:

means for receiving an impact from the core in the de-energized state of the coil and to transmit this impact to the elongated element to be driven into the ground; and rigid means disposed on said elongated element for supporting the elongated body at least during said energized state so as to receive a reaction force exerted on said body by said coil during the energized state, to transmit this force to the elongated element and to drive this element into the ground before each impact wherein a quenching network is connected to said first controllable switching means for rendering same nonconductive, and a second position sensor responsive to said core reaching an upper position for enabling said quenching network is provided on said elongated body.

22. An electromagnetic impact pile driver adapted to drive an elongated element into the ground in a substantially vertical orientation, said electromagnetic pile driver comprising:

an upright vertically elongated body having a vertical channel;

an electromagnet coil fixedly mounted on said body and surrounding said channel;

means for periodically storing a predetermined amount of electrical energy;

electrical energy storage means for applying repetitively on said coil a high energy current pulse of an adjustable level so as to cause for said pulse said coil to pass successively from an energized state to a de-energized state;

a mobile electromagnet core forming an impact mass guided in said channel and which is positioned with respect to said coil so as to be raised against gravity electromagnetically by said coil in said energized state and thereafter to free fall by gravity in said de-energized state; and a mobile anvil adapted to be positionable in contact with said elongated element and comprising:

means for receiving an impact from the core in the de-energized state of the coil and to transmit this impact to the elongated element to be driven into the ground; and rigid means disposed on said elongated element for supporting the elongated body at least during said energized state so as to receive a reaction force exerted on said body by said coil during the energized state, to transmit this force to the elongated element and to drive this element into the ground before each impact wherein said first controllable switching means is controlled by an electronic control circuit including a first position sensor located at the lower portion of the elongated body for triggering said first controllable switching means into conduction upon detection of the core by said first sensor, and by quenching network connected to said first switching means for rendering same non conductive, said quenching network comprising a second position sensor provided on an upper part of said elongated body and responsive to said core reaching an upper position for enabling said quenching network.

* * * * *